US012582885B2

(12) United States Patent
Vidalis

(10) Patent No.: US 12,582,885 B2
(45) Date of Patent: Mar. 24, 2026

(54) TOSS GAME TARGET APPARATUS

(71) Applicant: Stan Vidalis, Raleigh, NC (US)

(72) Inventor: Stan Vidalis, Raleigh, NC (US)

( * ) Notice: Subject to any disclaimer, the term of this patent is extended or adjusted under 35 U.S.C. 154(b) by 440 days.

(21) Appl. No.: 18/363,029

(22) Filed: Aug. 1, 2023

(65) Prior Publication Data

US 2023/0372797 A1 Nov. 23, 2023

Related U.S. Application Data

(63) Continuation-in-part of application No. 17/476,732, filed on Sep. 16, 2021, now abandoned.

(51) Int. Cl.

| | |
|---|---|
| ***A63B 63/08*** | (2006.01) |
| ***A63B 63/00*** | (2006.01) |
| ***A63B 71/06*** | (2006.01) |

(52) U.S. Cl.

CPC ..... *A63B 63/08* (2013.01); *A63B 71/06* (2013.01); *A63B 2063/002* (2013.01); *A63B 2071/0694* (2013.01)

(58) Field of Classification Search

CPC ..... A63B 71/06; A63B 2063/002

USPC ..... 273/402

See application file for complete search history.

(56) References Cited

U.S. PATENT DOCUMENTS

| | | | | |
|---|---|---|---|---|
| 10,881,932 | B2 | 1/2021 | Burns | |
| 2006/0091608 | A1* | 5/2006 | Yercha | A63B 67/06 273/348.4 |
| 2010/0140873 | A1* | 6/2010 | Britton | A63B 71/023 273/398 |
| 2014/0265138 | A1* | 9/2014 | Esposito | A63B 67/06 273/400 |
| 2020/0261782 | A1 | 8/2020 | Jimenez | |
| 2022/0339509 | A1* | 10/2022 | Carroll | A63B 67/06 |
| 2023/0104523 | A1* | 4/2023 | Baxter | A63B 67/06 473/594 |
| 2024/0226683 | A1* | 7/2024 | Elliott | A63B 63/08 |

* cited by examiner

*Primary Examiner* — Allyson N Trail

(74) *Attorney, Agent, or Firm* — James G Passe; Passe Intellectual Property

(57) ABSTRACT

An apparatus to play a projectile toss game having 4 sides that allows multiple users to play the game simultaneously and also having various sized holes with pockets that allow for a number of different games to be played.

6 Claims, 3 Drawing Sheets

TOSS GAME TARGET APPARATUS

This application is a continuation-in-part of U.S. non-provisional application Ser. No. 17/476,732 filed on Sep. 16, 2021, and which is incorporated herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to an apparatus designed for use in playing a target projectile toss game.

Description of Related Art

There is an array of projectile toss games currently on the market. Examples include Cornhole, ladder toss, golf chip, and beer pong. In each of these games, the users play by tossing a projectile towards one or more game targets with the object of getting the projectile into the supporting apparatus. Usual targets are a cup or a hole in the apparatus. A number of different projectiles are utilized including golf balls, ping pong balls, a bean bag, or the like.

A drawback of current toss games is that there is only one side of the apparatus that can be played with at one time. For example, in the case of Cornhole, there needs to be 2 boards positioned in spaced relationship from one another in order for two or more people to play. That's because they are designed to be played from a single angle. Some games are like skee-ball, in that if you miss one hole, your projectile will land in the next lowest one. That takes some of the skill out of the game.

BRIEF SUMMARY OF THE INVENTION

The present invention relates to a new toss game target apparatus which allows the users to play from 4 sides simultaneously. It also eliminates the requirement to have multiple apparatuses to play.

Accordingly, in one embodiment, there is a toss game target apparatus for use with a tossed projectile comprising:

a) a vertical upright frame consisting of four angled sides connected at their vertical edges and a flat horizontal top attached to a top of each of the four sides;

b) a plurality of vertically positioned holes on each angled side of the upright frame, wherein the holes are large enough to accept the tossed projectile and the holes in one angled side are identical to holes on each of the other angled sides; and c) one horizontally positioned hole in a flat horizontal top.

d) wherein the four sides are positioned at an angle to vertical of between 0 and 35 degrees and each hole has a soft pocket.

DETAILED DESCRIPTION OF THE INVENTION

Figure 1:
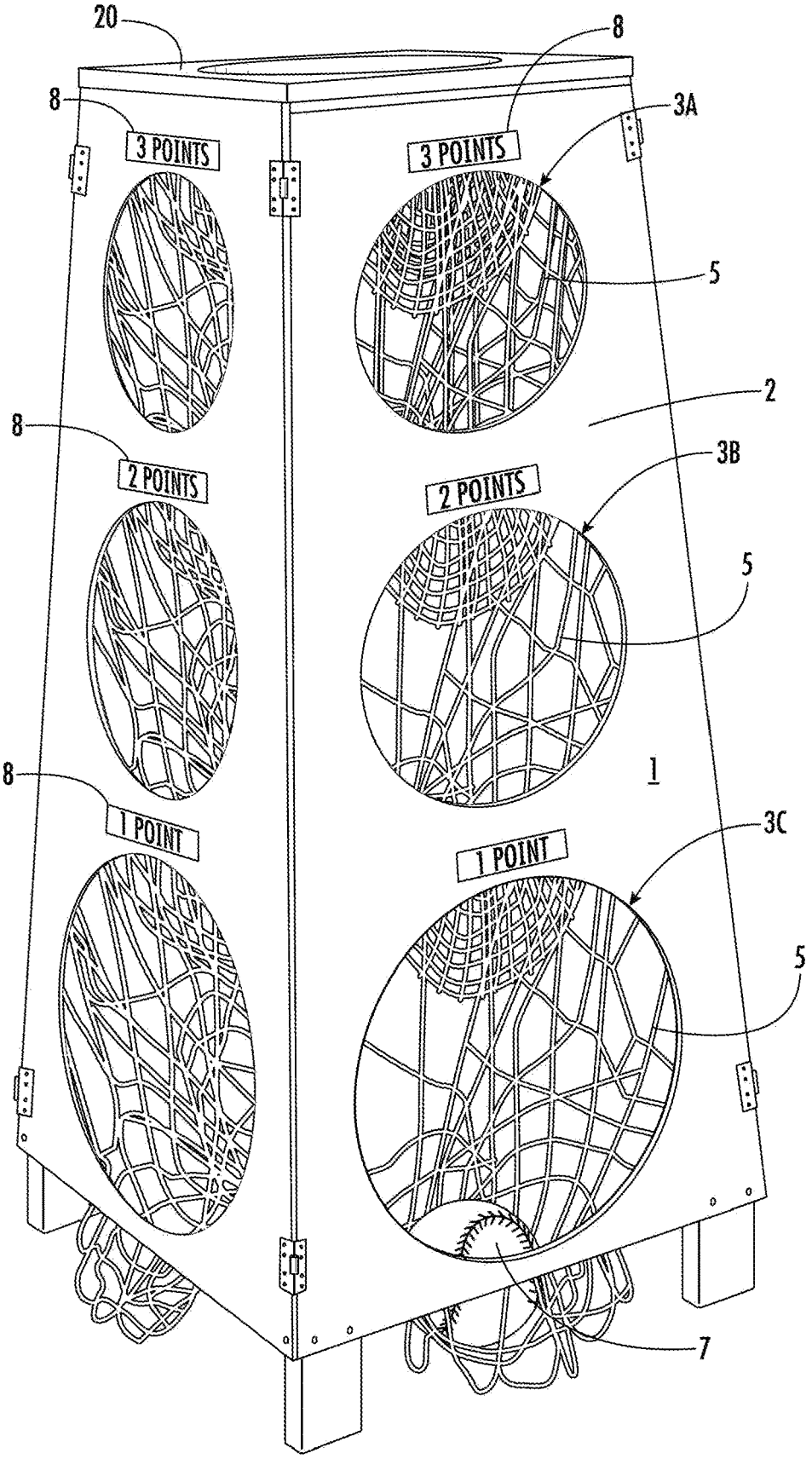
FIG. 1 is a perspective view of two sides of an embodiment, having four sides total of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "toss game target apparatus" refers to a throwing (tossing) game where individuals or teams toss a projectile (e.g., a ball, a bean bag, or the like) at a target hole, wherein points are accumulated based on the success of the projectile going into the target hole. The prior art single sided and multi sided toss game apparatus uses an approach, wherein the face is angled at 45 to 75 degrees or more from vertical. In the present application, the apparatus is a frame containing the same vertically angled holes on each side of 4 sides (made of wood, plastic, metal, and the like). The apparatus has 4 sides, wherein there are a plurality of the same vertically positioned (above each other on all 4 sides) holes; however, there must also be a top hole. The holes can be round, oval, or the like, and of a size to accept the projectile being thrown at the apparatus. The sides of the apparatus are tilted back and range from vertical (zero degrees) to about 35 degrees. In addition to the side holes, there is a single horizontally positioned hole in the flat top of the apparatus similar to the side holes that will accommodate the projectile. The holes can be different sizes to vary the difficulty in tossing the projectile into the hole. The holes can have a pocket to catch the projectile. The flat top is mounted on the top edge of all 4 sides (as shown in FIG. 1) and is thus supported by the 4 sides.

As used herein, the term "tossed projectile" refers to a ball, a bean bag, or the like, used with a toss game apparatus. The projectile needs to be of a size that can be tossed into each hole in the apparatus. In one embodiment, it refers to throwing the projectile by hand, or kicking. In another embodiment, the projectile is tossed using a device (e.g., golf club, racket, etc.).

As used herein, the term "vertical upright 4-sided frame" refers to an apparatus for use in a projectile toss game, wherein the sides are tilted back and range from vertical (zero degrees) to about 25 degrees back (relative to vertical). Each side has the same holes positioned as the other sides.

Each of the 4 sides allows a player to play from a different position, or players to play at the same time, thus allowing as many as 4 people/teams to play without a need for multiple apparatuses and at the same time.

As used herein, the term "vertically positioned holes" refers to the holes on each of the 4 sides, which are positioned one on top of another, such as shown in the figures. There are at least 3 vertically positioned holes on each side that has holes, each side being identical to the other sides. The holes can be any shape such as circular, oval, polygonal, and the like. In one embodiment, there are 3 vertically positioned holes on each side having the only holes on each sides are those designed to receive a projectile. In one embodiment the holes are round.

As used herein, the term "large enough" refers to the plurality of holes being of a sufficient size that whatever projectile is chosen, it will fit through the hole when correctly tossed by a user. The larger the hole, the easier to toss a projectile into it.

As used herein, the term "top" refers to a flat piece attached to the top of the 4 sides with one horizontal hole in the top. Once again, it has to be of a sufficient size to be able to accept a projectile, similar to the side holes. However, the hole will be positioned about 90 degrees relative to a zero degree vertical. In one embodiment, the top is flat. In one embodiment, the top is removable and the game can still be played with the remaining sides.

As used herein, the term "pocket" refers to each hole having soft fabric, mesh, or the like, designed to catch and hold the tossed projectile. The pocket makes the projectile easy to retrieve and prevents arguments over which hole the projectile went through. Each pocket on both the sides and top will have a soft pocket designed only to hold a projectile. A number of different games can be played with the apparatus, such as keeping score using a point system assigned to each hole, accuracy scoring, holes in a certain order, and the like.

DRAWINGS

Now referring to the drawings, FIG. 1 is a perspective view showing 2 sides of an embodiment, but having 4 sides total of the present invention. As mentioned above, each side has the same holes. This embodiment has 3 holes on each of the four sides. Each side is identical to the other sides, in this embodiment. Toss game target apparatus 1 has side 2, though there are four identical sides in this embodiment. Side 2, while it could be positioned completely upright (i.e., zero degrees), in this embodiment, the side tilts back from vertical by about 0 degrees to 35 degrees. Side 2 has three vertically positioned holes 3*a*, 3*b*, and 3*c*. In this view, the holes gradually increase in size from top to bottom with the lowest hole being the largest, but could all be the same size. Each hole has soft mesh pockets 5 for catching a ball or other projectile. In this view, projectile 7 is caught in the pocket of hole 3*c*. A top 20, attached flat to the top of the 4 sides, containing a hole is barely visible in this view. Also shown in FIG. 1, is point scoring indicators 8. All 4 sides are identical.

Figure 2:
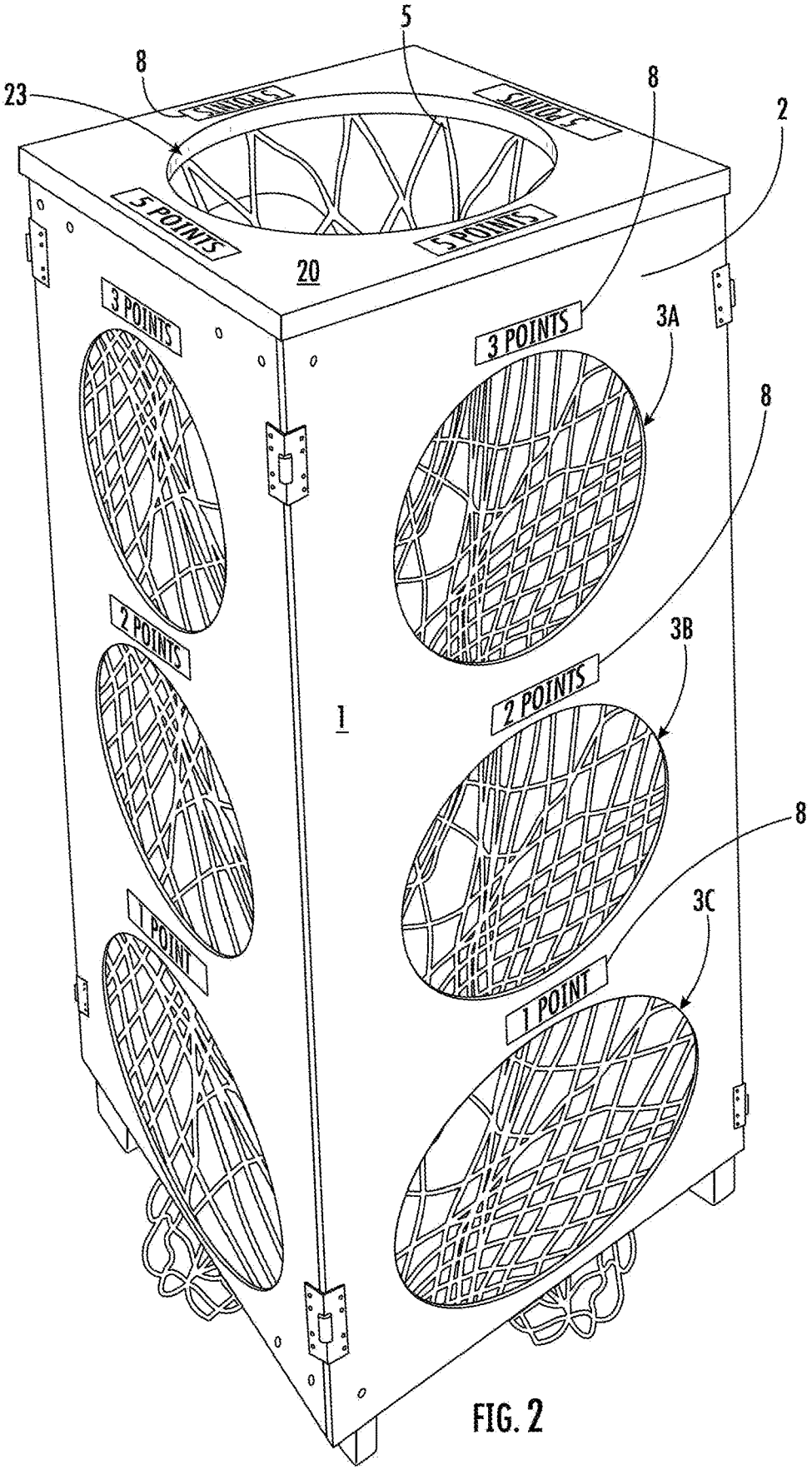
FIG. 2 is a top perspective view showing a hole with a mesh pocket of the present invention.

FIG. 2 is a top perspective view showing top 20 having a hole 23 with mesh pocket 5. It is noted that the top is mounted on the top edge of each side and thus the sides support the top. It is noted that this hole is bigger than the other holes on each side of the apparatus, but it is harder to get a projectile into it. In this embodiment, it is noted, the attached top 20 is flat.

Figure 3:
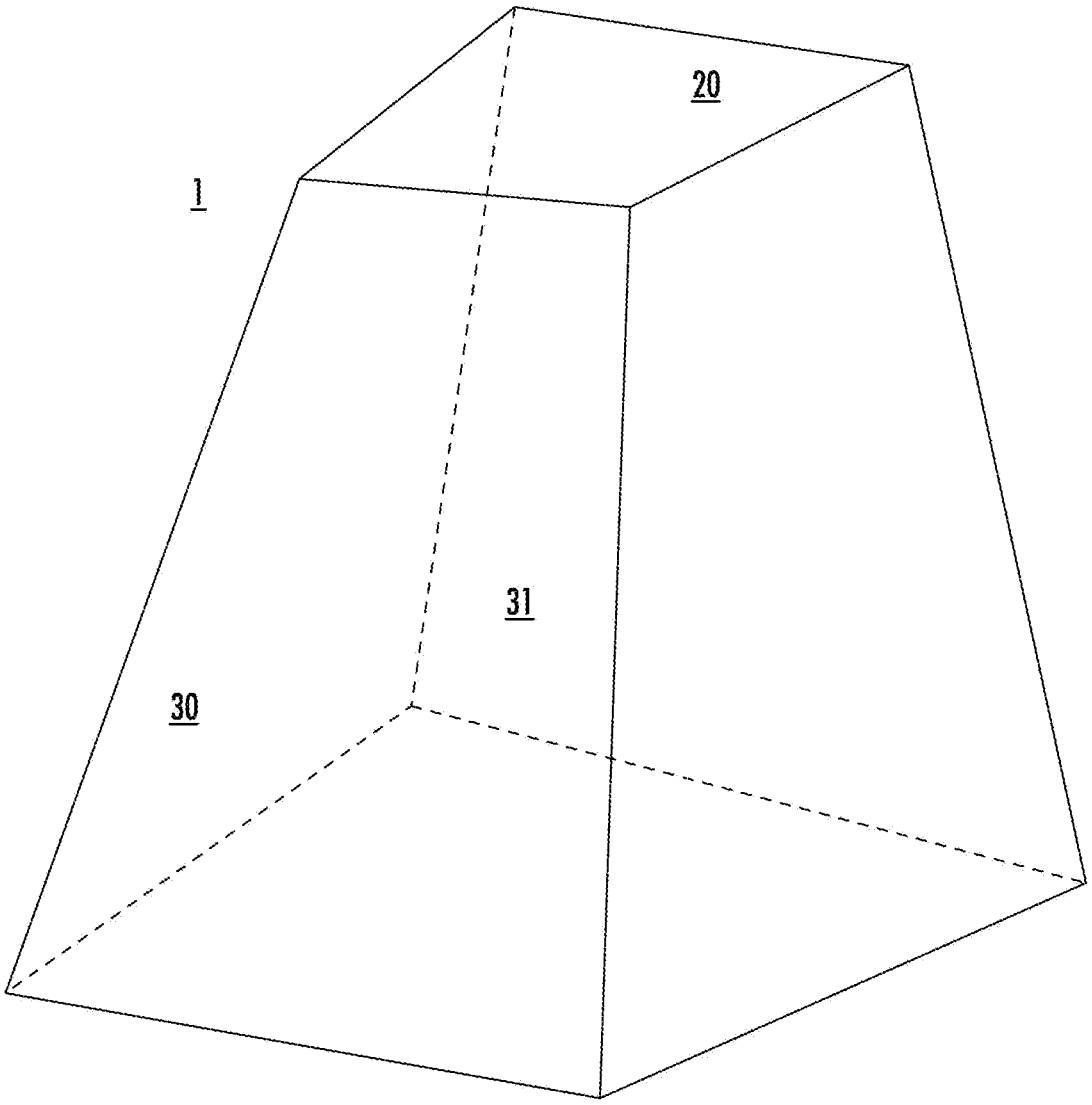
FIG. 3 is a see-through perspective view of FIG. 1 and FIG. 2 shown without holes and showing four sides of the present invention.

FIG. 3 is a see-through perspective view of the apparatus of the present invention of FIGS. 1 and 2, shown without the holes in order to show all the sides and the shape of toss game target apparatus 1. In this view, additional sides 30 and 31 can easily be seen, as well as the general shape of toss game target apparatus 1.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A toss game target apparatus for use with a tossed projectile comprising:

a) a vertical upright frame consisting of four angled sides connected at the vertical edge of each angled side and a flat horizontal top attached to a top of each of the four angled sides;

b) a plurality of vertically positioned holes on each angled side of the upright frame, wherein the holes are large enough to accept the tossed projectile, and the holes in one angled side are identical to holes on each of the other angled sides;

c) one horizontally positioned hole in the flat horizontal top; and d) wherein the four angled sides are positioned at an angle to vertical of between 0 and 35 degrees and each hole has a soft pocket.

2. The toss game target apparatus for use with a tossed projectile according to claim 1, wherein the holes on each angled side are not all the same size.

3. The toss game target apparatus for use with a tossed projectile according to claim 1, wherein the holes are round.

4. The toss game target apparatus for use with a tossed projectile according to claim 1, wherein there are three vertically positioned holes on each angled side.

5. The toss game target apparatus for use with a tossed projectile according to claim 1, wherein the soft pocket is a mesh material.

6. The toss game target apparatus for use with a tossed projectile according to claim 1, wherein the flat horizontal top is removable from the angled sides.

* * * * *